US009706285B2

(12) United States Patent
Lamb et al.

(10) Patent No.: US 9,706,285 B2
(45) Date of Patent: Jul. 11, 2017

(54) MOUNTING SYSTEM, DEVICE AND METHOD FOR AUDIO COMPONENTS

(71) Applicant: Point Source Audio, Inc., Petaluma, CA (US)

(72) Inventors: James Lamb, Novato, CA (US); Yvonne Ho, Novato, CA (US)

(73) Assignee: Point Source Audio, Inc., Petaluma, CA (US)

( * ) Notice: Subject to any disclaimer, the term of this patent is extended or adjusted under 35 U.S.C. 154(b) by 0 days.

(21) Appl. No.: 14/878,879

(22) Filed: Oct. 8, 2015

(65) Prior Publication Data

US 2017/0105062 A1 Apr. 13, 2017

(51) Int. Cl.
*H04R 25/00* (2006.01)
*H04R 1/10* (2006.01)

(52) U.S. Cl.
CPC ..... *H04R 1/105* (2013.01); *H04R 1/1033* (2013.01); *H04R 1/1066* (2013.01); *H04R 1/1075* (2013.01)

(58) Field of Classification Search
USPC ..... 381/330, 381, 379
See application file for complete search history.

(56) References Cited

U.S. PATENT DOCUMENTS

| | | | | |
|---|---|---|---|---|
| 4,020,297 | A * | 4/1977 | Brodie | H04M 1/05 379/430 |
| 7,613,292 | B2 * | 11/2009 | te Riet | H04R 1/1066 379/430 |
| D611,933 | S * | 3/2010 | Burnham | D14/223 |
| 8,985,538 | B2 * | 3/2015 | Rapoport | B62J 7/08 248/305 |
| 9,271,065 | B2 | 2/2016 | Lamb et al. | |
| 2010/0061581 | A1 * | 3/2010 | Soetejo | H04R 1/105 381/380 |

* cited by examiner

*Primary Examiner* — Amir Etesam

(57) ABSTRACT

An ear mount that is used to support one or more audio components proximate to a user's ear or head is disclosed. The ear mount can include one or more wire grooves to secure wires and/or the one or more audio components. The ear mount can be malleable so its shape can be customized for a given user. The ear mount can also be length alterable for customization of its size as well as placement of audio components. The ear mount also facilitates rapid setup and/or alteration for individual users whereby different audio components and/or their placement can be customized. The ear mount can also be colored or camouflaged to match the user's skin or clothing.

21 Claims, 9 Drawing Sheets

MOUNTING SYSTEM, DEVICE AND METHOD FOR AUDIO COMPONENTS

BACKGROUND

Personal headsets for audio systems have been in use for many years, and for a variety of different applications. Professionals that typically desire quality audio headsets can include, for example, musical or theater artists, telephone operators, dispatchers, airplane pilots, video camera operators, studio mixers, and professional sound technicians, among other various others. In many such occupations and applications, it may be desirable for such audio headsets to have speakers (e.g., earphones) and/or microphones. In the case of theater or musical productions, it is desirable that headset being worn by an artist not be noticeable to viewers, which can be members in an audience or viewers of a digital recording thereof.

Conventionally, artists have used a plastic ear hook or bent wire to form an ear hook and then attached their microphone thereto with adhesive tape or cable binding sleeves (e.g., Hellerman sleeves). Unfortunately, such "ear rigs" are cumbersome and difficult to assemble, and require anywhere from twenty (20) minutes to an hour to build a single "ear rig" depending on the experience of the technician. Additionally, "ear rigs" are ad hoc solutions and tend to be klugey. The conventional "ear rig" is also not sleek or stylish. Further still, once a conventional "ear rig" is made, it is difficult to alter or even adjust the "ear rig." Accordingly, the conventional "ear rig" is merely a rigged solution and thus is not designed for comfort, nor is the conventional "ear rig" preconfigured or designed to support audio components.

SUMMARY

The invention pertains to an ear mount that is used to support one or more audio components proximate to a user's ear or head. The ear mount can include one or more wire grooves to secure wires and/or the one or more audio components. The ear mount can be malleable so its shape can be customized for a given user. The ear mount can also be length alterable for customization of its size as well as placement of audio components. The ear mount also facilitates rapid setup and/or alteration for individual users whereby different audio components and/or their placement can be customized. The ear mount can also be colored or camouflaged to match the user's skin or clothing. The ear mount can also be referred to as an ear mounting device.

Embodiments of the invention can be implemented in numerous ways, including as a device, apparatus, system or method. Several embodiments of the invention are discussed below.

As an ear mounting apparatus for one or more audio components, one embodiment can, for example, include at least a preconfigured ear mount that has an upper arm and a lower arm. The preconfigured ear mount can include a front surface and a back surface, where the back surface includes at least one wire groove extending from a rear end to a forward end.

As an ear mounted audio system, one embodiment includes at least an ear mount including an upper arm and a lower arm, and an audio component with a wire connected thereto. The ear mount also has a front surface and a back surface, the back surface including an exposed first wire groove extending from a rear end to a forward end of the upper arm, and the back surface including an exposed second wire groove extending from the rear end to a forward end of the lower arm. The exposed first wire groove or the exposed second wire groove can have at least a portion of the wire provided and secured therein, with the audio component being provided proximate to a forward most portion of the upper arm or the lower arm.

As a kit for an ear mounted audio system, one embodiment can, for example, include at least an ear mount, and an audio component with a wire connected thereto. The ear mount can include an upper arm and a lower arm, and the ear mount can include a front surface and a back surface. The back surface can include an exposed wire groove extending from a rear end to a forward end of the upper arm and/or the lower arm. The exposed wire groove can be configured to receive at least a portion of the wire provided therein, such that the audio component is able to be held by the ear mount, with the audio component being provided proximate to a forward most portion of the upper arm and/or the lower arm.

As a kit for an ear mounted audio system, one embodiment can, for example, include at least an ear mount, a first audio component with a first wire connected thereto, and a second audio component with a second wire connected thereto. The ear mount can include an upper arm and a lower arm, and the ear mount can include a front surface and a back surface. The back surface can include an exposed first wire groove extending from a rear end to a forward end of the upper arm, and the back surface can include an exposed second wire groove extending from the rear end to a forward end of the lower arm. The exposed first wire groove can be configured to receive at least a portion of the first wire provided therein, such that the first audio component is able to be held by the ear mount, with the first audio component being provided proximate to a forward most portion of the upper arm. The exposed second wire groove can be configured to receive at least a portion of the second wire provided therein, such that second audio component is able to be held by the ear mount, with the second audio component being provided proximate to a forward most portion of the lower arm.

As an ear mounted audio system, one embodiment can, for example, include a preconfigured ear mount, a first audio component and a second audio component. The preconfigured ear mount can include an upper arm and a lower arm, and can include a front surface and a back surface. The back surface can include an exposed first wire groove extending from a rear end to a forward end of the upper arm, and the back surface can include an exposed second wire groove extending from the rear end to a forward end of the lower arm. The first audio component can have a first wire connected thereto, and the exposed first wire groove can have at least a portion of the first wire provided therein, with the first audio component being provided proximate to a forward most portion of the upper arm. The second audio component can have a second wire connected thereto, and the exposed second wire groove can have at least a portion of the second wire provided therein, with the second audio component being provided proximate to a forward most portion of the lower arm.

As a method for assembling one or more ear mounted audio components, one embodiment can, for example, include at least the acts of: providing an ear mount having one or more wire grooves; identifying one or more audio components to secure to the ear mount; positioning the one or more audio components relative to the ear mount; and securing one or more wires corresponding to the one or more audio components in the one or more wire grooves.

Other aspects and advantages of embodiments of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF EMBODIMENTS OF THE INVENTION

The invention pertains to an ear mount that is used to support one or more audio components proximate to a user's ear or head. The ear mount can include one or more wire grooves to secure wires and/or the one or more audio components. The ear mount can be malleable so its shape can be customized for a given user. The ear mount can also be length alterable for customization of its size as well as placement of audio components. The ear mount also facilitates rapid setup and/or alteration for individual users whereby different audio components and/or their placement can be customized. The ear mount can also be colored or camouflaged to match the user's skin or clothing. The ear mount can also be referred to as an ear mounting device.

The ear mount described herein is suitable to be positioned about a user's ear. The ear mount is typically configured differently for the use on the user's left ear versus the right ear. That is, there is typically a left shaped ear mount and a right shaped ear mount. Certain figures described herein depict embodiments of a right shaped ear mount, and other figures described herein depict embodiments of a left shaped ear mount.

In various embodiments for the ear mount, the ear mount includes an upper arm and a lower arm. The ear mount facilitates adaptive microphone placement, as desired by user. As such, a microphone can be placed above the ear using the upper arm or placed below the ear using the lower arm. Alternatively, multiple microphones can be utilized, such as a first microphone coupled to the upper arm and a second microphone coupled to the lower arm. The ear mount also can facilitate your earphone placement, as desired by user. For example, an earphone can be placed above the user's ear using the upper arm.

The design of the ear mount also facilitates not only customization for a user, but also detachment, replacement, and adjustment of audio components with respect to the ear mount.

The various aspects, features, embodiments or implementations of the invention described above can be used alone or in various combinations.

Embodiments of various aspects of the invention are discussed below with reference to FIGS. 1A-8. However, those skilled in the art will readily appreciate that the detailed description given herein with respect to these figures is for explanatory purposes as the invention extends beyond these limited embodiments.

Figure 1A:
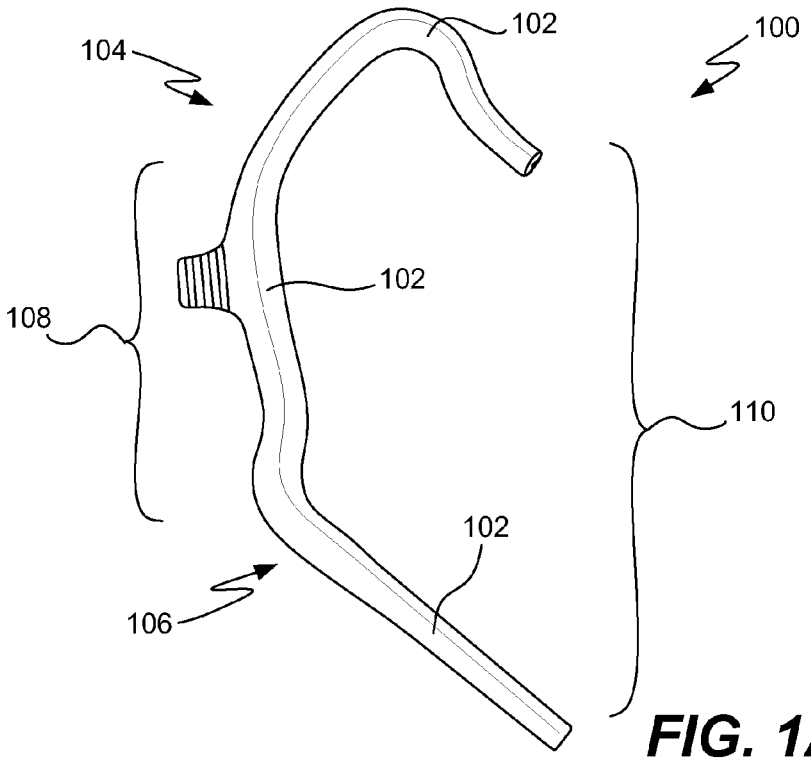
FIG. 1A is a front side view of an ear mount according to one embodiment.

FIG. 1A is a front side view of an ear mount 100 according to one embodiment. The ear mount 100 has a front surface 102. The ear mount 100 is typically worn by a user to support one or more audio components proximate the user's head. The one or more audio components can, for example, include one or more microphones and/or one or more earphones. The front surface 102 is an exposed outer surface of the ear mount 100 while being worn about a user's ear.

The ear mount 100 also includes an upper arm 104 and a lower arm 106. While being worn about a user's ear, the upper arm 104 is over the user's ear, and lower arm 106 is under or behind the user's ear. The ear mount 100 also includes a rear end 108 and a forward end 110. The rear end 108 is at a rear section of the ear mount 105. The forward end 110 is at a forward section of the ear mount 100.

Figure 1B:
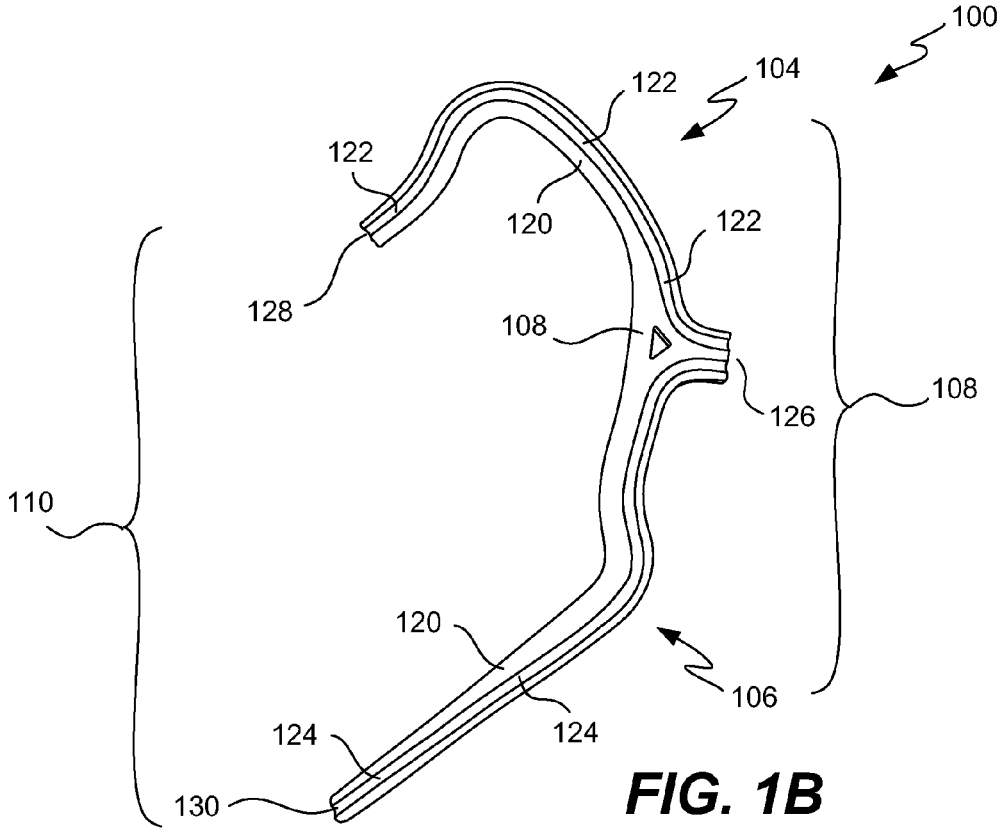
FIG. 1B illustrates a back side view of the ear mount according to the embodiment shown in FIG. 1A.

FIG. 1B illustrates a back side view of the ear mount 100 according to one embodiment. The ear mount 100 has a back surface 120. The back surface 120 further includes a first groove 122 and a second groove 124. The first groove 122 extends from a rear section 126 at the rear end 108 along the upper arm 104 to a first forward end 128. The second groove 124 extends from the rear section 126 at the rear end 108 along the lower arm 106 to a second forward end 130. Although the thickness of the first groove and the second groove 124 can vary depending on implementation, in one implementation, the groove thickness is 0.05 mm.

In one embodiment, the ear mount 100 is configured to fit over an ear of a user. In one implementation, the ear mount 100 can be formed from a malleable or pliable material so that the ear mount 100 can be conformed to better fit about their ear. The ear mount 100 can be formed of plastic, metal, ceramic, wood, etc., or some combination thereof. In one implementation, the ear mount 100 is formed of a plastic material that can be molded into the desired configuration. For example, the ear mount 100 can be made of Polyvinyl Chloride (PVC) with a Durometer of 60, which is medium hard but somewhat malleable.

In one embodiment, the ear mount 100 can be capable of being formed in a particular color and/or painted to have a particular color. It is sometimes advantageous to camouflage the presence of the ear mount 100 being worn by a user. In such cases, it is often desirable to camouflage the ear mount 100 by coloring the ear mount 100 to best match the color of the user's skin or clothing.

Figure 2A:
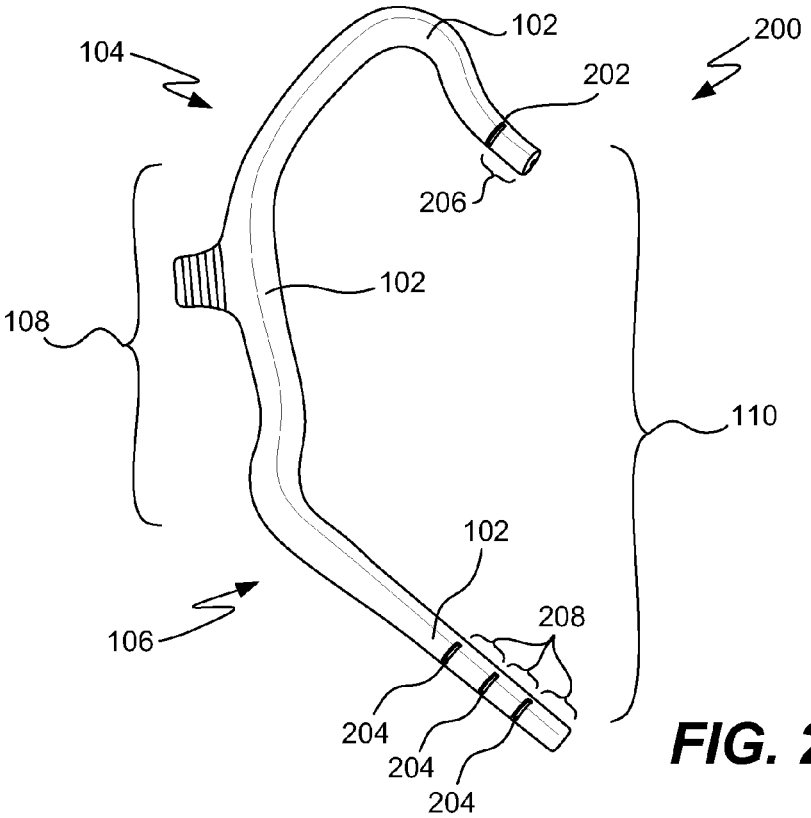
FIG. 2A is a front side view of an ear mount according to another embodiment.

FIG. 2A is a front side view of an ear mount 200 according to another embodiment. The ear mount 200 shown in FIG. 2A is similar to the ear mount 100 illustrated in FIG. 1A. However, the ear mount 200 can further include one or more trim points 202 at the upper arm 104 such that the upper arm 104 can be shortened, and can include one or more trim points 204 such that the lower arm 106 can be shortened. Namely, the upper arm 104 can be shortened by breaking off one or more trim sections 206 at the trim point 202, and/or the lower arm 106 can be shortened by breaking off one or more trim sections 208 at the trim point 204.

Figure 2B:
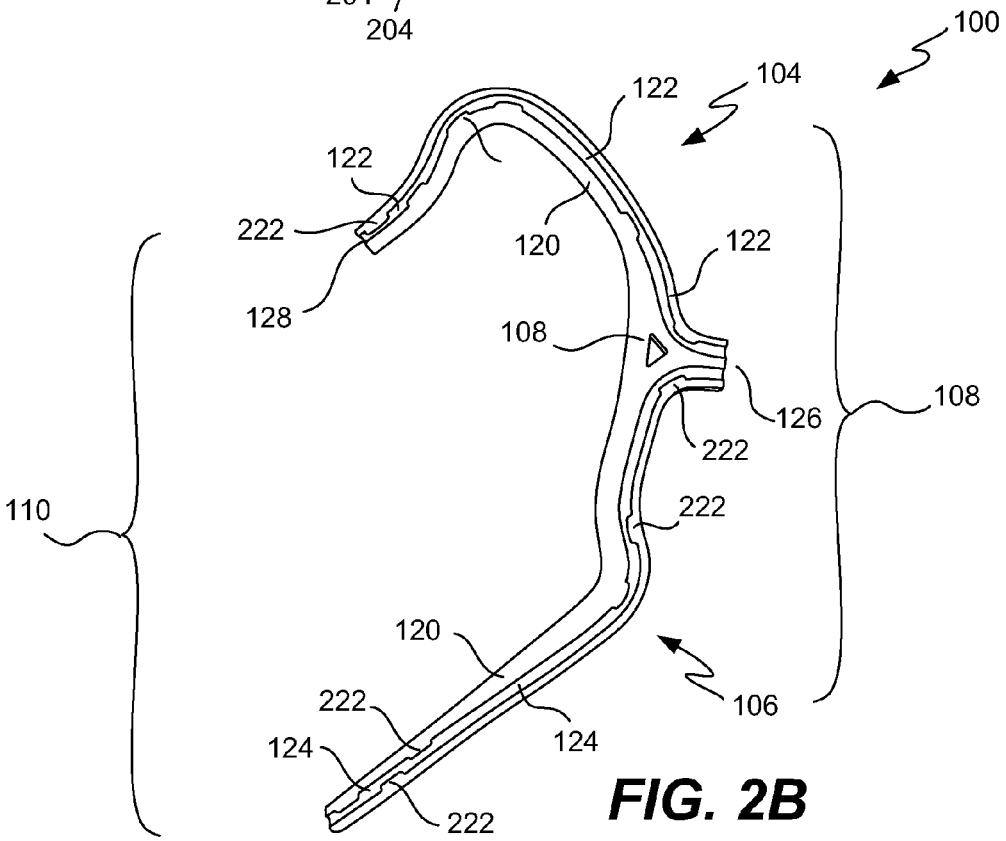
FIG. 2B illustrates a back side view of the ear mount according to the embodiment shown in FIG. 1B.

FIG. 2B illustrates a back side view of the ear mount 200 according to one embodiment. The ear mount 200 shown in FIG. 2B is similar to the ear mount 100 illustrated in FIG. 1B. The ear mount 200 can further include one or more wire retention members 222. The one or more wire retention members 222 are provided adjacent or in the first groove 122 and the second groove 124. The one or more wire retention members 222 can serve to retain a wire within the respective groove. In one implementation, the one or more wire retention members 222 can be tabs or protrusions formed in or adjacent to the first groove 122 or the second groove 124. In one embodiment, the one or more wire retention members 222 can serve to impose additional resistance for the wire being placed within the respective groove, thereby securing the wire within the groove.

Figure 3A:
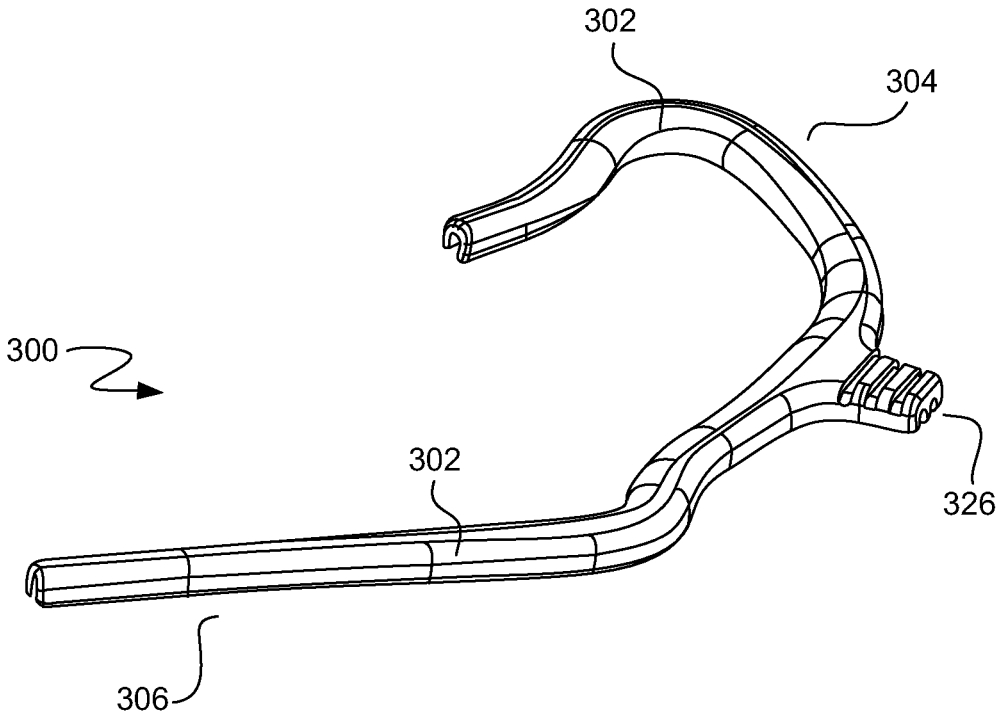
FIGS. 3A-3G are different views of an ear mount according to one embodiment.
Figure 3B:
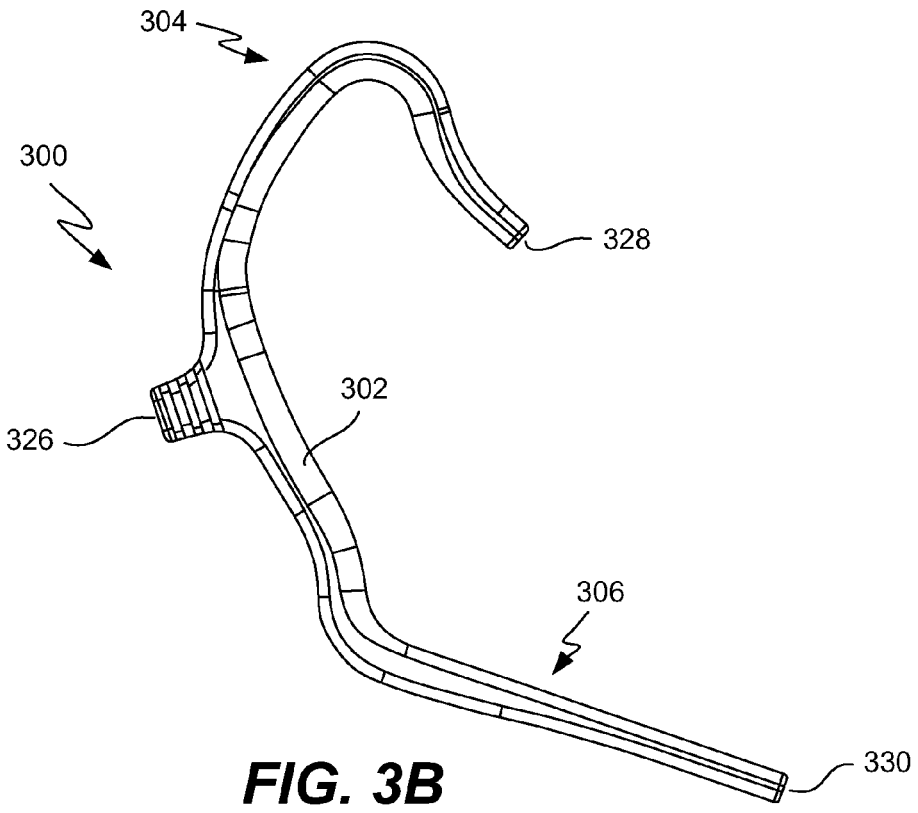
Figure 3C:
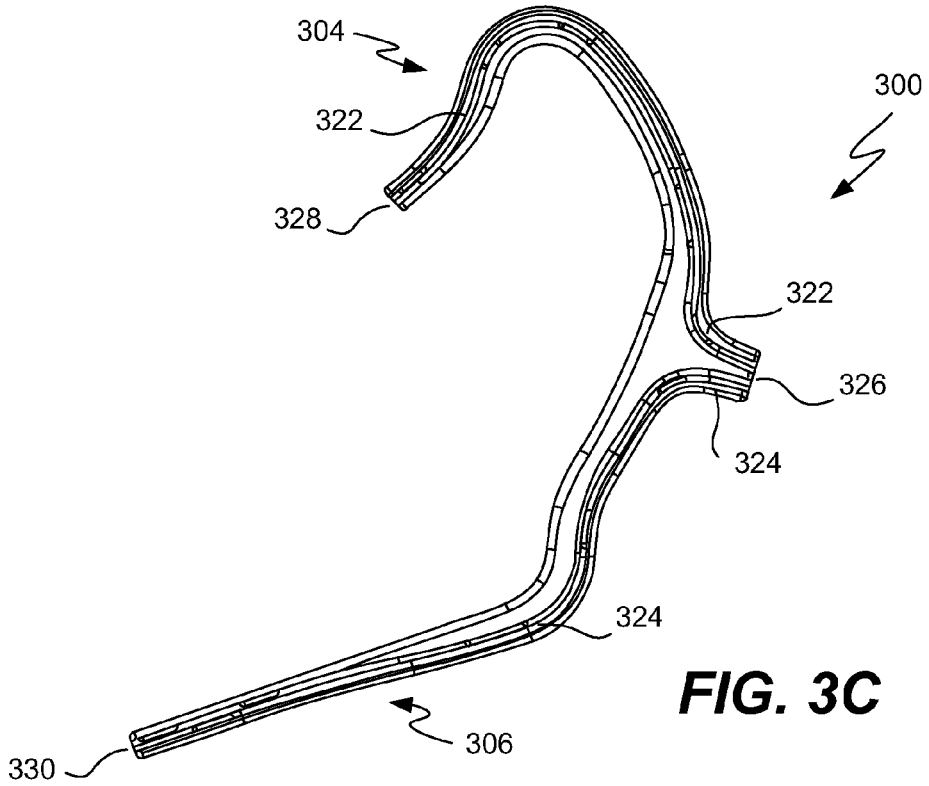
Figure 3D:
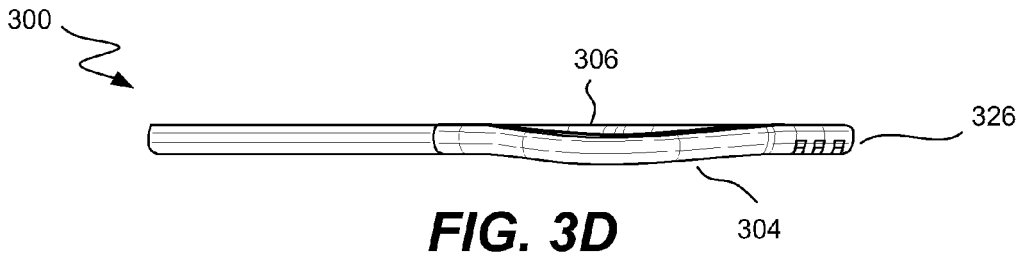
Figure 3E:
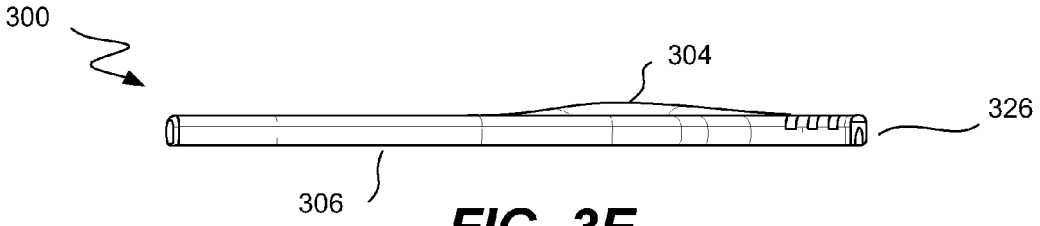
Figure 3F:
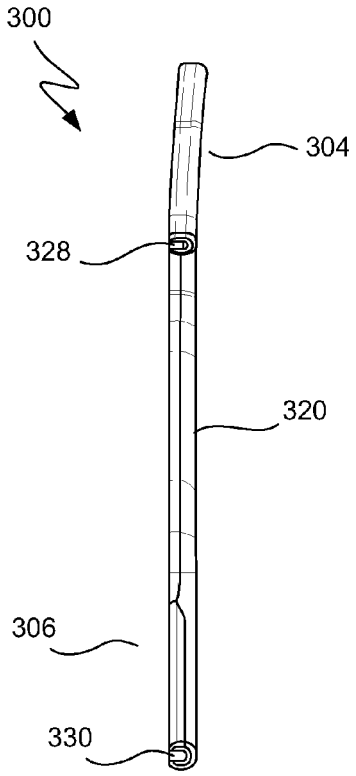
Figure 3G:
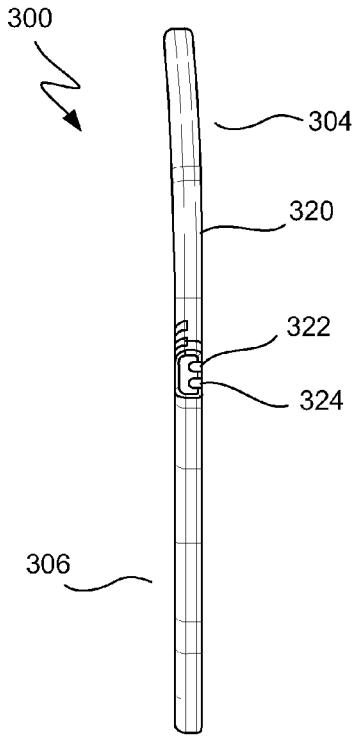

FIGS. 3A-3G are different views of an ear mount 300 according to one embodiment. FIG. 3A is an outer perspective view of the ear mount 300, FIG. 3B is a front view of the ear mount 300, FIG. 3C is a back view of the ear mount 300, FIG. 3D is a top side view of the ear mount 300, FIG. 3E is a bottom side view of the ear mount 300, FIG. 3F is a left side view of the ear mount 300, and FIG. 3G is a right side view of the ear mount 300. The ear mount 300 is generally similar to the ear mount 100 shown in FIGS. 1A and 1B.

The ear mount 300 is typically worn by a user to support one or more audio components proximate the user's head. The one or more audio components can, for example, include one or more microphones and/or one or more earphones. A front surface 302 is an exposed outer surface of the ear mount 300 while being worn about a user's ear. The ear mount 300 includes an upper arm 304 and a lower arm 306. While being worn about a user's ear, the upper arm 304 is over the user's ear, and lower arm 306 is under or behind the user's ear.

The ear mount 300 also has a back surface 320. The back surface 320 includes a first groove 322 and a second groove 324. The first groove 322 extends from a rear section 326 at a rear end along the upper arm 304 to a first forward end 328. The second groove 324 extends from the rear section 326 at the rear end along the lower arm 306 to a second forward end 330. Although the thickness of the first groove and the second groove 324 can vary depending on implementation, in one implementation, the groove thickness is 0.05 mm.

Figure 4:
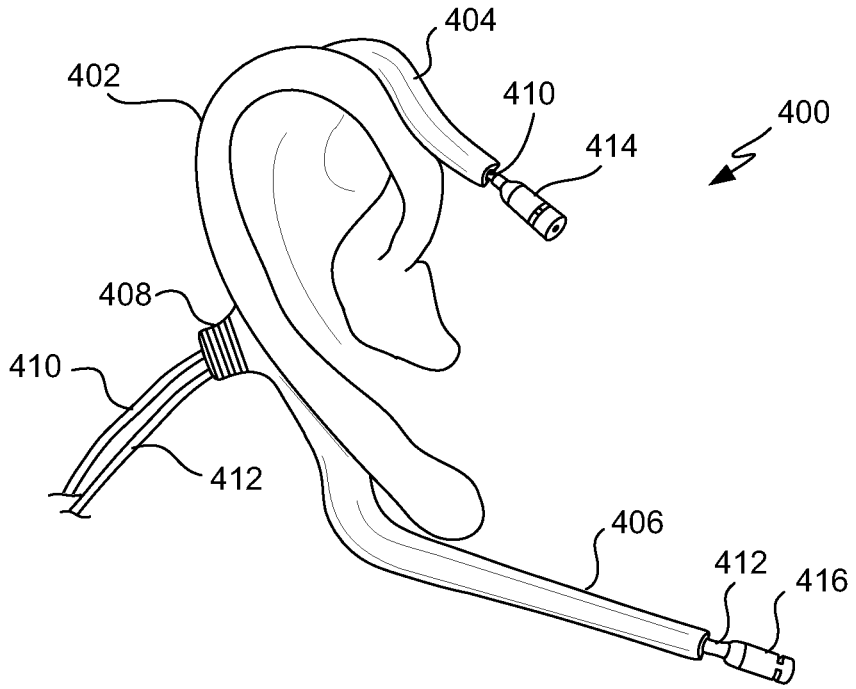
FIG. 4 illustrates a perspective view of an ear mount according to one embodiment.

FIG. 4 illustrates a perspective view of an ear mount 400 according to one embodiment. The ear mount 400 is illustrated in position about an ear 402 of a user. The ear mount 400 includes an upper arm 404 and a lower arm 406. The ear mount 400 also includes a rear section 408. A first wire 410 and a second wire 412 are shown exiting the rear section 408. Typically, the first wire 410 and the second wire 412 would be coupled to an audio system (not shown).

The first wire 410 is contained within a first groove. This first groove is accessible from the backside of the ear mount 400. (see e.g., FIG. 1B) The first groove extends from the rear section 408 through the upper arm 404. The first wire 410 when placed within the first groove thus also extends from the rear section 408 along or through the upper arm 404 and exits the forward most position of the upper arm 404. As shown in FIG. 4, a first audio component 414 is connected to the first wire 410 that exits the forward most position of the upper arm 404. Notably, the upper arm 404 can support the first audio component 414 in position. In this embodiment, although not required, the upper arm 404 supports the first audio component 414 in position using the first wire 410 secured within the first groove. The first wire 410 is also electrically coupled to the first audio component 414. In the embodiment illustrated in FIG. 4, the first audio component 414 is depicted as a microphone, in which case audio sounds in the vicinity of the first audio component 414 (microphone) can be picked up and provided to the audio system.

The second wire 412 is contained within a second groove. This second groove is accessible from the backside of the ear mount 400. (see e.g., FIG. 1B) The second groove extends from the rear section 408 through the lower arm 406. The second wire 412 when placed within the second groove thus also extends from the rear section 408 along or through the lower arm 406 and exits the forward most position of the lower arm 406. As shown in FIG. 4, a second audio component 416 is connected to the second wire 412 that exits the forward most position of the lower arm 406. Notably, the lower arm 406 can support the second audio component 416 in position. The second wire 412 is also electrically coupled to the second audio component 416. In this embodiment, although not required, the lower arm 406 supports the second audio component 416 in position using the second wire 412 secured within the second groove. In the embodiment illustrated in FIG. 4, the second audio component 416 is depicted as a microphone, in which case audio sounds in the vicinity of the second audio component 416 (microphone) can be picked up and provided to the audio system.

Figure 5:
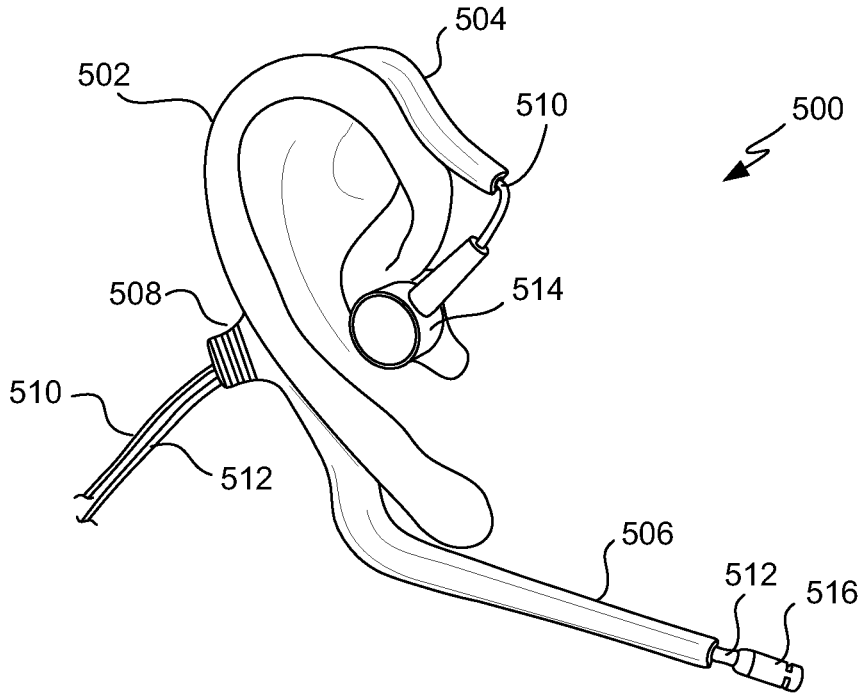
FIG. 5 illustrates a perspective view of an ear mount according to one embodiment.

FIG. 5 illustrates a perspective view of an ear mount 500 according to one embodiment. The ear mount 500 is illustrated in position about an ear 502 of a user. The ear mount 500 includes an upper arm 504 and a lower arm 506. The ear mount 500 also includes a rear section 508. A first wire 510 and a second wire 512 are shown exiting the rear section 508. Typically, the first wire 510 and the second wire 512 would be coupled to an audio system.

The first wire 510 is contained within a first groove. This first groove is accessible from the backside of the ear mount 500. The first groove extends from the rear section 508 through the upper arm 504. The first wire 510 when placed within the first groove thus also extends from the rear section 508 along or through the upper arm 504 and exits the forward most position of the upper arm 504. As shown in FIG. 5, a first audio component 514 is connected to the first wire 510 that exits the forward most position of the upper arm 504. Notably, the upper arm 504 can support the first audio component 514 in position. The first wire 510 is also electrically coupled to the first audio component 514. In the embodiment illustrated in FIG. 5, the first audio component 514 is depicted as an earpiece that can be placed within the user's ear. The earpiece allows audio sounds provided by the audio system and output by the first audio component 514 (earphone) to be delivered to the user's ear.

The second wire 512 is contained within a second groove. This second groove is accessible from the backside of the ear mount 500. The second groove extends from the rear section 508 through the lower arm 506. The second wire 512 when placed within the second groove thus also extends from the rear section 508 along or through the lower arm 506 and exits the forward most position of the lower arm 506. As shown in FIG. 5, a second audio component 516 is connected to the second wire 512 that exits the forward most position of the lower arm 506. Notably, the lower arm 506 is supporting the second audio component 516 in position. The second wire 512 is also electrically coupled to the second audio component 516. In the embodiment illustrated in FIG. 5, the second audio component 516 is depicted as a microphone, in which case audio sounds in the vicinity of the second audio component 516 (microphone) can be picked up and provided to the audio system.

Figure 6:
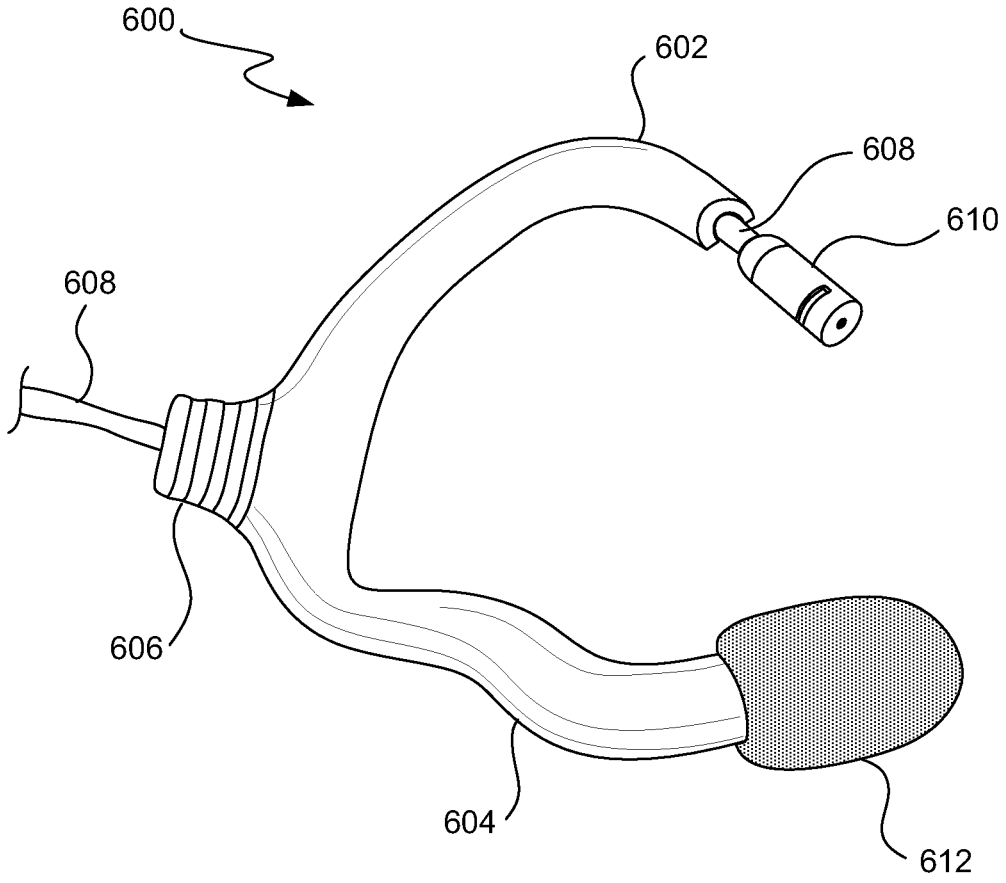
FIG. 6 illustrates a perspective view of an ear mount according to one embodiment.

FIG. 6 illustrates a perspective view of an ear mount 600 according to one embodiment. The ear mount 600 in configured to fit about an ear of a user. The ear mount 600 includes an upper arm 602 and a lower arm 604. The ear mount 600 also includes a rear section 606. A wire 608 is shown exiting the rear section 606. Typically, the wire 608 is coupled to an audio system.

The wire 608 is contained within a groove (not shown). The groove is accessible from the backside of the ear mount 600. The groove extends from the rear section 606 through the upper arm 602. The wire 608 when placed within the groove thus also extends from the rear section 606 along or through the upper arm 602 and exits the forward most position of the upper arm 602. As shown in FIG. 6, an audio component 610 is connected to the wire 608 that exits the forward most position of the upper arm 602. The upper arm 602 can support the audio component 610 in position. The wire 608 is also electrically coupled to the audio component 610. In the embodiment illustrated in FIG. 6, the audio component 602 is depicted as a microphone, in which case audio sounds in the vicinity of the audio component 610 (microphone) can be picked up and provided to the audio system. The lower arm 604 in this embodiment is shortened, as compared to the lower arms 406 and 506 shown in FIGS. 4 and 5. The lower arm 604 can be initially configured as a shorter length or can be initially formed in a longer length and then shortened. In one implementation, the lower arm 604, which is shortened, can fit behind the user's ear. For example, with the lower arm 604 short or shortened, the end of the lower arm 604 is able to fit snugly into a cavity just behind the user's ear lobe, which assists with securing or stabilizing the ear mount 600 relative to the user's ear and/or head. Optionally, a cover 612, such as a pad, can be provided over the end of the lower arm 604 for greater user comfort.

Figure 7:
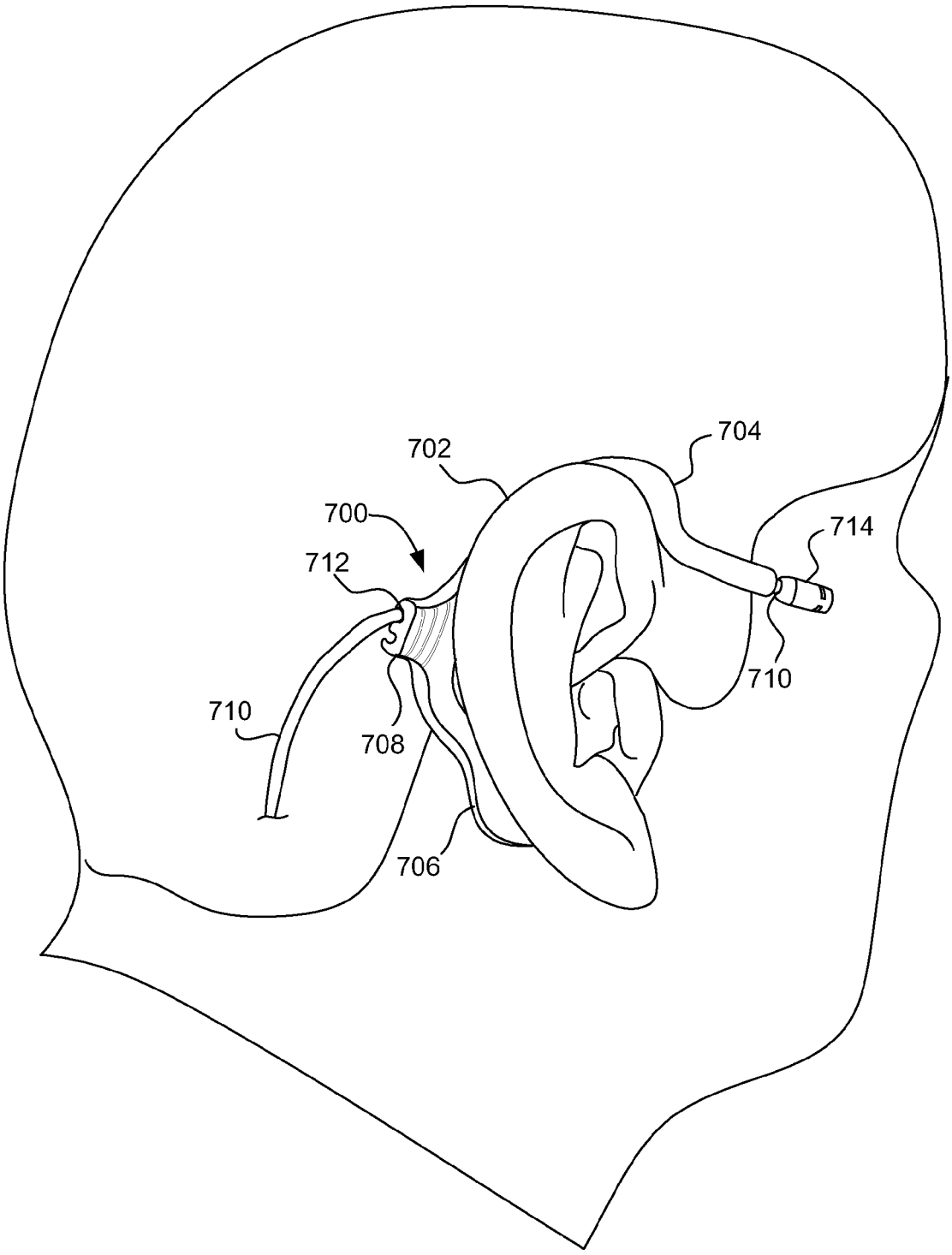
FIG. 7 illustrates a perspective view of an ear mount according to one embodiment.

FIG. 7 illustrates a perspective view of an ear mount 700 according to one embodiment. The ear mount 700 is configured to fit about an ear of a user. As shown in FIG. 7, the ear mount 700 is illustrated in position about an ear 702 of a user's head. The ear mount 700 includes an upper arm 704 and a lower arm 706. The lower arm 706 is short so that it fits behind the user's ear. For example, the lower arm 706 can be similar to the lower arm 604 shown in FIG. 6. The ear mount 700 also includes a rear section 708. A wire 710 is shown exiting the rear section 708. Typically, the wire 710 is coupled to an audio system (not shown).

The wire 710 is fit within a groove 712 that is accessible from the backside of the ear mount 700. The groove 712 extends from the rear section 708 through the upper arm 704. The wire 710 when placed within the groove 712 can extend from the rear section 708 along or through the upper arm 704 and exit the forward most position of the upper arm 704. As shown in FIG. 7, an audio component 714 is connected to the wire 710 that exits the forward most position of the upper arm 704. The upper arm 704 can support the audio component 714 in position (e.g., directly or indirectly via the sire 710). The wire 710 is also electrically coupled to the audio component 714. In the embodiment illustrated in FIG. 7, the audio component 714 is depicted as a microphone, in which case audio sounds in the vicinity of the audio component 710 (microphone), such as from the user' mouth, can be picked up and provided to the audio system. Note, as compared to the ear mount 500 illustrated in FIG. 7, the upper arm 704 is longer than the upper arm 502, while the lower arm 706 and the lower arm 504 are both relatively short so that they fit behind the user's ear. Although the ear mount 700 includes at least the groove 712, it should be noted that the ear mount 700 can but need not include one or more other grooves.

Figure 8:
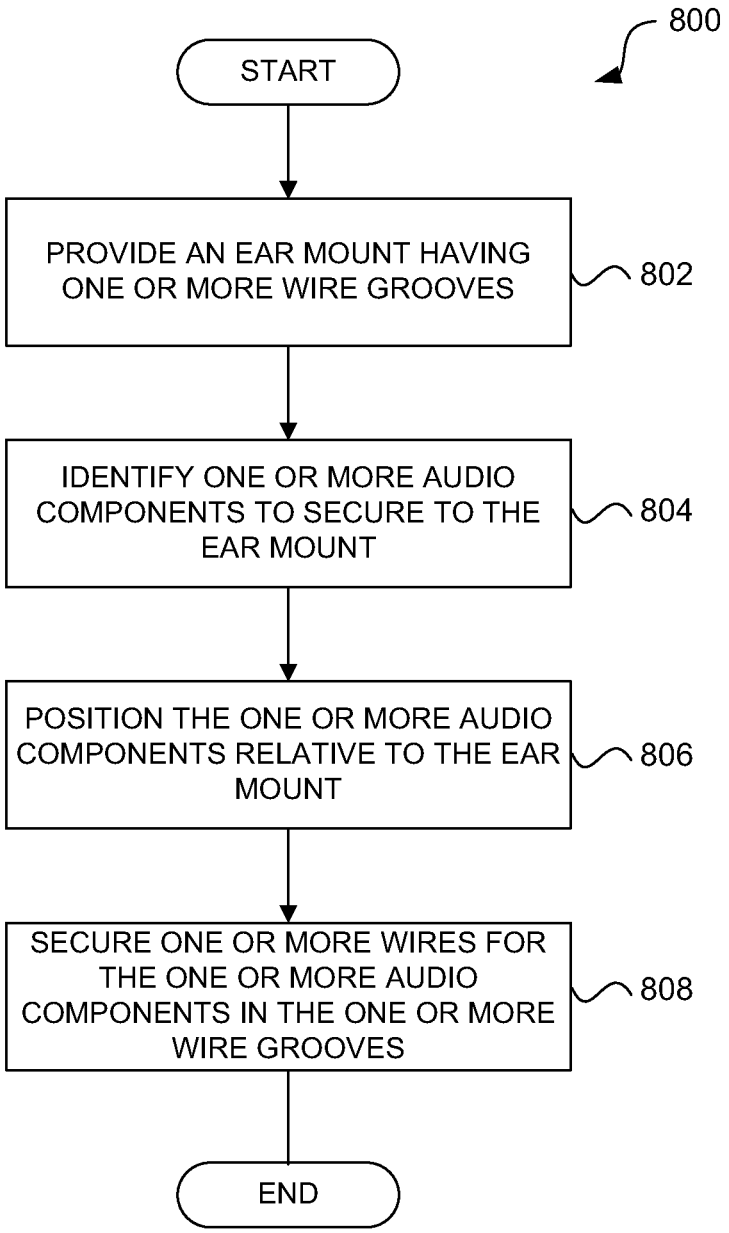
FIG. 8 illustrates a flow diagram of an ear mount assembly method according to one embodiment.

FIG. 8 illustrates a flow diagram of an ear mount assembly method 800 according to one embodiment. The ear mount assembly method 800 can serve to secure one or more audio components and their respective wires to the ear mount. The resulting ear mount is able to be quickly assembled while also being able to be customized as well as camouflaged.

The ear mount assembly method 800 can initially provide 802 an ear mount having one or more wire grooves. In addition, one or more audio components that are to be secured to the ear mount can be identified 804. For example, the one or more audio components can vary depending upon implementation. For example, in one embodiment, the ear mount can have one microphone secured thereto. In another example, the ear mount can have two microphone secured thereto. In a further example, the ear mount can have one earphone secured thereto. In still another embodiment, the ear mount can have one microphone and one earphone secured thereto. In still further other embodiments, more than two audio components can be secured to the ear mount.

Next, the ear mount assembly method can position 806 the one or more audio components relative to the ear mount. Here, the one or more audio components that are to be secured to the ear mount can be positioned 806 relative to the ear mount. This establishes the desired position for the one or more audio components relative to the ear mount. Thereafter, the corresponding wires for the one or more audio components can be secured 808 in the one or more wire grooves. The wire grooves can operate to secure the corresponding wires therein. In addition, in one embodiment, the one or more wire grooves by securing the corresponding one or more wires can also secure the corresponding one or more audio components to the ear mount. By securing the wires to the one or more wire grooves in the ear mount, the wires are able to be secured in position so as not to dangle or tangle and also to facilitate camouflaging the presence of the wires. The wires can also be managed such that they exit from a rear portion of the ear mount (e.g., FIG. 4, rear section 408), which tends to hide the wires behind the user's ear.

In general, the ear mount also facilitates hiding the wires for the audio component(s). That is, the ear mount itself hides the wires secured thereto (e.g., in wire grooves), and the exit of the wires from behind the user's ear also facilitates hiding of the wires.

As noted above, the audio component(s) can be positioned above or below the user's ear. Also, any of the arms of an ear mount can be trimmed to a shorter length if so desired. The arms can be trimmed a predetermined trim points or at any other point without impacting basic functionality of the ear mount so long as the ear mount is able to be held to the user's head about the user's ear.

Also, ear mounts according to various embodiments can use one or more wire grooves. For example, an upper arm might have one or multiple grooves, and a lower arm might have none, one or multiple grooves.

One type of audio component is a microphone. One suitable microphone is referred to as a lavalier microphone, which is a small electret or dynamic microphone, such as often use for theatre or and public speaking applications in order to allow for hands-free operation. Another type of audio component is an earphone. An earphone can, for example, also be or include an earbud.

The various aspects, features, embodiments or implementations of the invention described above can be used alone or in various combinations.

Numerous specific details are set forth in order to provide a thorough understanding of the present invention. However, it will become obvious to those skilled in the art that the invention may be practiced without these specific details. The description and representation herein are the common meanings used by those experienced or skilled in the art to most effectively convey the substance of their work to others skilled in the art. In other instances, well-known methods, procedures, components, and circuitry have not been described in detail to avoid unnecessarily obscuring aspects of the present invention.

In the foregoing description, reference to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams representing one or more embodiments of the invention do not inherently indicate any particular order nor imply any limitations in the invention.

The many features and advantages of the invention are apparent from the written description. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. An ear mounting apparatus for one or more audio components, said ear mounting apparatus comprising:

a preconfigured ear mount, the preconfigured ear mount including an upper arm and a lower arm, the preconfigured ear mount including a front surface and a back surface, and the back surface including at least a first wire groove extending from a rear end to a forward end of the upper arm, and a second wire groove extending from the rear end and a forward end of the lower arm, wherein the lower arm has at least one denoted trim section which can be removed to shorten the lower arm.

2. An ear mounting apparatus as recited in claim 1, wherein the first wire groove is exposed at the back surface.

3. An ear mounting apparatus as recited in claim 2, wherein the first wire groove includes a plurality of wire retention members in or adjacent the first wire groove.

4. An ear mounting apparatus as recited in claim 3, wherein the plurality of wire retention members are tabs.

5. An ear mounting apparatus as recited in claim 2, wherein the second wire groove is exposed at the back surface.

6. An ear mounting apparatus as recited in claim 5, wherein the back surface includes a plurality of wire retention members in or adjacent the second wire groove.

7. An ear mounting apparatus as recited in claim 6, wherein the plurality of wire retention members are tabs.

8. An ear mounting apparatus as recited in claim 5, wherein the rear end has a wire exit region where the first wire groove and the second wire groove are provided adjacent one another.

9. An ear mounting apparatus as recited in claim 1, wherein the preconfigured ear mount is deformable.

10. An ear mounting apparatus as recited in claim 1, wherein the upper arm has at least one denoted trim point configured to facilitate shortening of the upper arm.

11. An ear mounting apparatus as recited in claim 10, wherein the lower arm has at least one denoted trim point configured to facilitate shortening of the lower arm.

12. An ear mounting apparatus, for one or more audio components, said ear mounting apparatus comprising:

a preconfigured ear mount, the preconfigured ear mount including an upper arm and a lower arm, the preconfigured ear mount including a front surface and a back surface, and the back surface including at least a first wire groove extending from a rear end to a forward end of the upper arm, and a second wire groove extending from the rear end and a forward end of the lower arm, wherein the upper arm has at least one denoted trim section which can be removed to shorten the upper arm.

13. An ear mounting apparatus as recited in claim 12, wherein the lower arm has at least one denoted trim section which can be removed to shorten the lower arm.

14. An ear mounting apparatus as recited in claim 1, wherein a forward most portion of the upper arm is adapted to receive an audio component, and the first wire groove in the upper arm is adapted to receive a wire coupled to the audio component.

15. An ear mounting apparatus as recited in claim 14, wherein the audio component is secured to the preconfigured ear mount.

16. An ear mounting apparatus as recited in claim 14, wherein the audio component is secured to the preconfigured ear mount by the wire.

17. An ear mounting apparatus as recited in claim 14, wherein the audio component is a microphone.

18. An ear mounting apparatus as recited in claim 14, wherein the audio component is an earphone.

19. An ear mounting apparatus as recited in claim 1, wherein the preconfigured ear mount is adapted to be worn about a single ear of a user.

20. An ear mounted audio system, comprising:

an ear mount, the ear mount including an upper arm and a lower arm, the ear mount including a front surface and a back surface, the back surface including an exposed first wire groove extending from a rear end to a forward end of the upper arm, and the back surface including an exposed second wire groove extending from the rear end to a forward end of the lower arm; and an audio component with a wire connected thereto, the exposed first wire groove or the exposed second wire groove having at least a portion of the wire provided and secured therein, with the audio component being provided proximate to a forward most portion of the upper arm or the lower arm, wherein the upper and/or lower arm has at least one denoted trim section which can be removed to shorten the corresponding upper and/or lower arm.

21. A kit for ear mounted audio system, said kit comprising:

an ear mount, the ear mount including an upper arm and a lower arm, the ear mount including a front surface and a back surface, the back surface including an exposed first wire groove extending from a rear end to a forward end of the upper arm, and the back surface including an exposed second wire groove extending from the rear end to a forward end of the lower arm;

a first audio component with a first wire connected thereto; and a second audio component with a second wire connected thereto, wherein the exposed first wire groove is configured to receive at least a portion of the first wire provided therein, such that the first audio component is able to be held by the ear mount, and provided proximate to a forward most portion of the upper arm, and wherein the exposed second wire groove is configured to receive at least a portion of the second wire provided therein, such that second audio component is able to be held by the ear mount, and provided proximate to a forward most portion of the lower arm, wherein the upper and/or lower arm has at least one denoted trim section which can be removed to shorten the corresponding upper and/or lower arm.

* * * * *